US005405464A

United States Patent [19]

Mosser

[11] Patent Number: 5,405,464

[45] Date of Patent: Apr. 11, 1995

[54] RIDERS FOR THE PROCESSING OF STEEL AND METHOD FOR USING

[75] Inventor: John E. Mosser, Sarver, Pa.

[73] Assignee: Allegheny Ludlum Corporation, Pittsburgh, Pa.

[21] Appl. No.: 87,938

[22] Filed: Jul. 6, 1993

[51] Int. Cl.[6] ..... C21B 3/00

[52] U.S. Cl. ..... 148/656; 266/274; 269/289 R

[58] Field of Search ..... 148/656; 266/274, 279, 266/287; 269/289 R, 296, 303, 291; 432/261, 253

[56] References Cited

U.S. PATENT DOCUMENTS

| | | | |
|---|---|---|---|
| 1,932,496 | 10/1933 | Watzke | 266/279 |
| 1,965,780 | 7/1934 | Odland | 269/289 R |
| 3,095,182 | 6/1963 | Platt | 269/289 R |
| 3,589,694 | 6/1971 | Gelling et al. | 432/261 |
| 4,186,916 | 2/1980 | Varga | 269/303 |

*Primary Examiner*—Scott Kastler
*Attorney, Agent, or Firm*—Patrick J. Viccaro

[57] ABSTRACT

Method and apparatus for supporting a steel slab and protecting the bottom surface of the slab as the slab is advanced over a skid bar system through a slab heating furnace and which includes at least a first member for supporting the weight of the steel slab and protecting the slab's bottom surface, and a second member for contacting an edge portion of the steel slab. The second member of the apparatus is comprised of a material which is substantially non-consumable, or may be coated or lined with a material which renders it non-consumable, at the operating temperatures of a slab heating furnace and which inhibits the movement of carbon from the rider into the steel slab. In the alternative, the method may include coating the slab edge with a layer having high temperature stability and low thermal conductivity.

15 Claims, 1 Drawing Sheet

RIDERS FOR THE PROCESSING OF STEEL AND METHOD FOR USING

BACKGROUND OF THE INVENTION

1. Field of the Invention

The present invention relates to an apparatus and method for supporting and transporting steel during processing. More particularly, the present invention relates to an apparatus and method for protecting steel slabs during transport through a slab heating furnace.

2 . Description of the Invention Background

During processing, steel slabs often must be brought to elevated temperatures so that the steel may be hot worked. For example, slabs of certain types of stainless steel are heated to temperatures in the range of 1950° F. to 2350° F. for hot rolling into coils. The steel slabs may be brought to the required elevated temperature by passing the slabs through a reheat furnace. The slabs may be in the as-cast or the ground surface condition.

To facilitate movement of the heavy slabs into and out of the reheat furnace and minimize the contact with the slab surface, pathways of parallel, raised support members, referred to as "skid bars", may be used In a representative skid bar system, illustrated in FIG. 1, the steel slabs 5 are pushed into the reheat furnace 10 along four raised, parallel skid bar rails 15. While in the furnace, the steel slabs 5 ride on skid bars made of metal. Near the furnace exit, the slabs sit on a solid refractory base to permit the slab temperature to equalize. On exiting the furnace, the slab 5 is pushed back on to the four rails and is dropped out onto table rolls to carry the slab to the hot strip mill. Normally, the skid bars are water-cooled to protect the skid bars, but which also tends to remove heat from the areas of the slab which contact the skid bars.

Although the skid bar system aids in transporting the steel slabs and reduces contact with the slab surface, the skid bars themselves may damage the surface of the slabs. Slabs of certain types of steel, such as ferritic stainless steel, are relatively more susceptible to physical marking on the slab's bottom surface when the slab slides over the skid bars. The marks may be carried onto the surface of the coil when the slab is subsequently hot rolled. The marked coil surface must then be conditioned to remove the marks. Conditioning is an additional, costly processing step which decreases yield and increases the cost of the finished product.

To prevent slab marking, it is known in the stainless steel industry to use sacrificial sheet metal riders between the skid bars and the slab surfaces. However, because of the materials used therein and the particular construction thereof, some skid bar systems do not allow for use of such sheet metal riders.

From the foregoing, it is apparent that there is a need for a device which will protect steel slabs from skid bar marking during the slab's movement through a slab heating furnace. Accordingly, it is an object of the invention to provide an apparatus which will support a steel slab and protect the surface of the steel slab while it advances over skid bars.

SUMMARY OF THE INVENTION

To satisfy the above-stated objective, the present invention provides for a rider, preferably made of wood, which is a body including a first member shaped to contact the bottom surface of a steel slab. The first member is made of a material which will both support the weight of the steel slab and protect the bottom surface of the slab from marking when the slab is moved over a skid bar system through a heating furnace. The rider also includes a second member configured to contact a side surface of the steel slab and cause the rider to advance with the slab. The second member is substantially non-consumable at the operating temperature of the furnace and may include a coating or liner of a material which inhibits the movement of carbon from the rider to the steel slab when the slab/rider combination is heated to elevated temperatures in a furnace. In addition, the present invention discloses a method for transporting through a furnace steel slabs on the riders and providing on the second member of the rider or on the edge of the steel slab a coating which is both highly temperature stable and has low thermal conductivity.

DETAILED DESCRIPTION OF THE INVENTION

To protect the bottom surface of a steel slab and to prevent damage to the coil produced therefrom, a slab-supporting device, or "rider" was produced. A representative rider of the preferred construction is shown in the accompanying FIGS. 1 through 3. At least a portion of the rider is constructed of a material which is capable of supporting the weight of the slab and which will withstand the abrasive force created when the slab is pushed over the skid bars and along the refractory base of a slab heating furnace. Because it is low weight, readily available, low cost, and easy to work with, a preferred material satisfying these requirements is wood. It is contemplated, however, that materials other than wood will also support a slab's weight and resist abrasive forces. Examples of alternative materials include refractory boards and heavy gage steel; however, neither of those materials is consumable in the sense that wood is here.

The rider includes a base portion, which will contact the base of the steel slab, and a side portion, which contacts the edge of the steel slab in the direction of movement of the slab. It is the rider's base portion which must support the weight of the slab and resist the abrasive forces created by the sliding of the slab over a surface. The rider's side portion prevents the slab from sliding off of the base portion when the slab is advanced.

Figure 1:
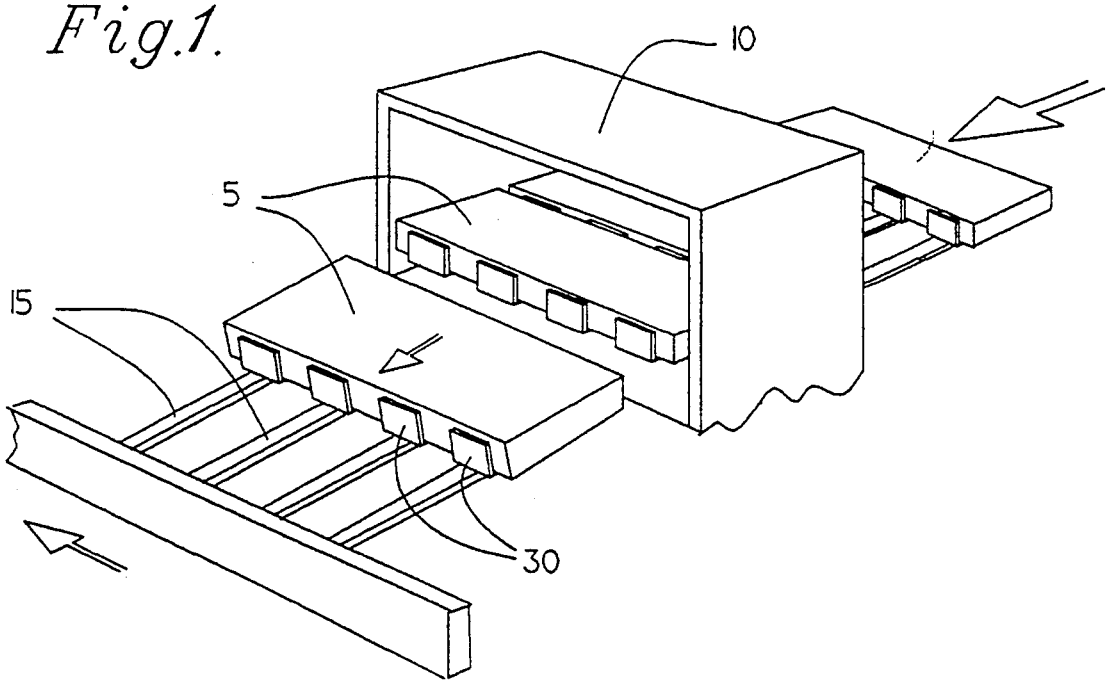
FIG. 1 depicts steel slabs disposed on the riders of the present invention advancing through a reheat furnace on a system of parallel skid bars.
Figure 2:
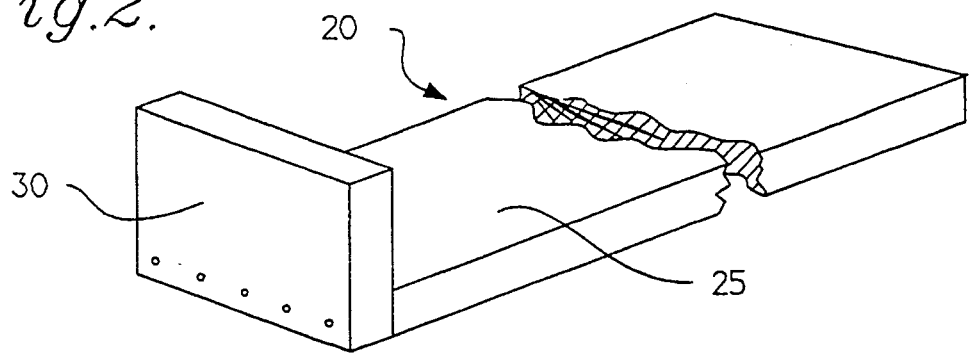
FIG. 2 is a perspective view of a partially cut-away rider of the present invention.
Figure 3:
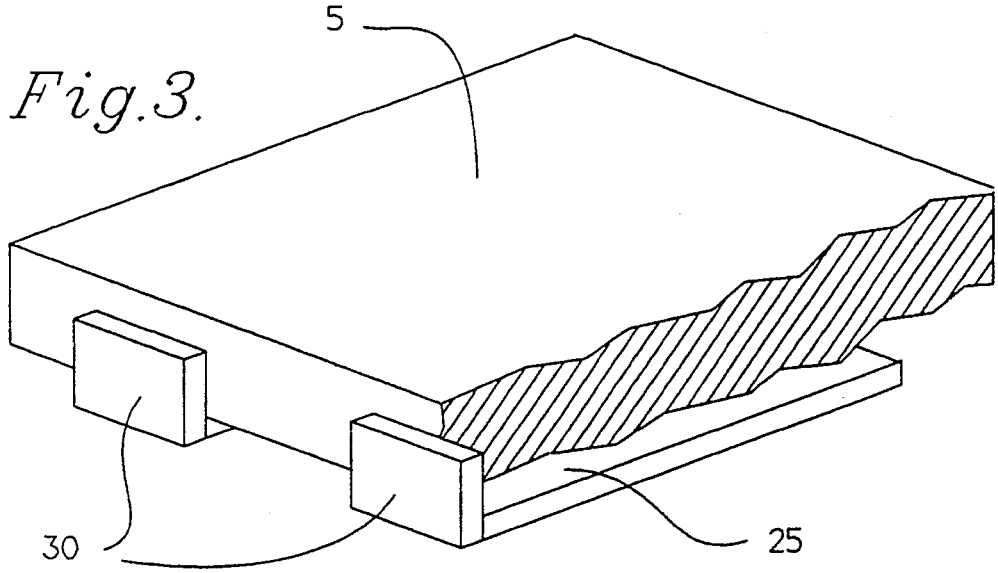
FIG. 3 is a perspective view of a partially cut-away steel slab supported on the riders of the present invention.

As shown in FIG. 2, a preferred embodiment of the rider 20 is constructed of a first member 25 and a second member 30 attached thereto. As shown in FIG. 2, the first and second members of the preferred embodiment are attached by, for example, nails or screws, to form a substantially L-shaped rider. As shown in FIG. 3, when in use the first member 25 is disposed so as to contact the bottom surface of the slab 5 and the second member 30 is disposed so as to contact an edge of the slab 5. Further, as shown in FIG. 1, the substantially vertically oriented second member causes the rider to advance through the furnace along with the slab and separates the individual slabs.

The L-shaped riders are preferably smaller than the dimensions of the steel slab. For example, in the preferred embodiment shown in FIG. 3, the second member extends about 5 inches along the height of an 8 inch high slab and the first member extends about ⅔ of the width of the bottom surface of the slab, e.g., 38 inches along a 52 inch-wide slab.

Experimentation has shown that the use of wooden riders to transport steel slabs into a reheat furnace prevents the marking by skid bars of the bottom surface of the slab. In addition, hot rolled coils produced from slabs heated on the riders to approximately 2050° F. exhibited no slab-related defects, such as unacceptable carbon pickup.

Although bottom surface marking is significantly reduced by using the riders of the present invention, it has been found that steel slabs, and the hot rolled coils produced therefrom, may be metallurgically affected by the use of wooden riders. During the hot rolling of slabs of certain steel types heated to certain higher temperatures, such as 2250° F. or more, in a reheat furnace on the wooden riders of the present invention, areas or bands of relatively severe edge checking may appear on the coils rolled from those slabs. These edge checks were found to extend much deeper into the coil width than edge checks which normally occur during hot rolling. In addition to bands of relatively severe edge checking, portions of the coil in the regions of severe edge checking may separate from the coil during rolling and be deposited on the coil surface as rolled-in metal slugs.

These coil defects may require additional coil processing. Coils which include the severe edge checking may require relatively deep edge trimming before cold rolling. It has been experienced that after the additional trimming operations the coils may be too narrow to satisfy the specifications of customers' orders. Removing the rolled-in metal slugs also requires an additional processing step, either a repickle or a coil grind. If not removed, the metal slugs could be rolled out into holes in the sheet during subsequent processing.

The areas of severe edge checking were found to be associated with regions of relatively high carbon content. It is believed that carbon from the decomposition of the wooden riders in the furnace may diffuse into the edge surface of the steel slab when the slab is in contact with the wood at elevated temperatures. Diffusion of carbon into the steel slab produces carbon-enriched regions having reduced melting temperatures. In the case of AISI type 419 stainless steel, for example, as the carbon content in the carbon-enriched regions on the edge surface of the slab approaches 4.0%, the melting temperature of the steel is lowered below the operating temperature of the reheat furnace (2250° F.) used to process the stainless steel. The melting and re-solidification of the carbon-enriched steel regions produces a rough surface on the slab edge and also creates cracks which extend into the portions of the slab which are not enriched by the diffused carbon. It is believed that during hot rolling of the affected slab, the combination of the rough surface and the deeper cracks produce the bands of severe edge checking on the coil edges.

In the case of the preferred wooden rider, it is believed that it is carbon diffusion from the decomposition of the second member, in contact with the slab edge, which is the primary source of damage to the hot rolled coils. While the slab is in the furnace, both the first and second members of a wooden rider are charred and are substantially consumed. Although carbon is deposited on the slab's bottom surface by decomposition of the first member, the quality of that surface is not significantly affected thereby. Further processing of the hot rolled band by, for example, blasting and pickling, has been found to remove all remnants of the carbon deposited on the slab's bottom surface. In contrast, as discussed above, subsequent hot processing does not satisfactorily eliminate coil defects caused by carbon-enriched regions on the slab's edge produced from decomposition of the second member.

It is to be understood that while wooden riders satisfied the objective of reduced marking of the slab's bottom surface when the slab is advanced over skid bars, it was found that possible carbon pick-up from wooden riders may affect coil quality. Experiments were conducted to produce a wooden rider which also inhibits the diffusion of carbon therefrom.

A study was conducted to identify a material which will chemically isolate the wooden portion of a rider from a steel slab and inhibit the diffusion of carbon from the wood to the slab's edge. Various experimental coatings and liners were applied to the portion of a wooden rider in contact with the edge surface of the slab. AISI type 419 stainless steel slabs were reheated on the experimental riders at 2250° F. in a Salem reheat furnace. The heated experimental slabs were then hot rolled to sheet and coiled using procedures familiar to those skilled in the art. The hot rolled bands were evaluated for edge condition in regions where the experimental rider contacted the slab edge. The carbon pickup of the slab from the rider was also evaluated.

Both uncoated silicon steel and uncoated carbon steel liners applied to the wooden riders failed to inhibit carbon diffusion sufficient to significantly increase hot rolled band edge quality. In addition to those metallic liner materials, several coatings and liners which included refractory materials were also tested. The group of refractory materials, which includes, for example, alumina, silica, and magnesium oxide, have low thermal conductivity and may withstand extremely high temperatures, such as the operating temperatures of furnaces used in steel processing. Materials exhibiting high temperature stability and low thermal conductivity were selected because it is believed that preventing the second member of the wooden rider from combusting and being consumed in the reheat furnace prevents the diffusion of carbon therefrom into the steel slab.

The following coatings and liners were applied to wooden riders of the present invention: (i) one sheet of ⅛ inch Fiberfrax paper; (ii) three sheets of ⅛ inch Fiberfrax paper (⅜ inch total); (iii) ¼ inch Fiberfrax board; (iv) a colloidal suspension of silica; (v) a fully-suspended silica slurry; (vi) ¼ inch Fiberfrax board coated with a colloidal suspension of silica; and (vii) 0.014 inch silicon steel coated with a magnesium oxide slurry.

Fiberfrax is the trademark for a family of refractory ceramic fiber products, available from The Carborundum Company, Niagara Falls, N.Y., which have high temperature stability, low thermal conductivity, and high resistance to thermal shock. Fiberfrax material is available as both a rigid, lightweight ceramic fiber board, marketed under the trademark Duraboard, and a ceramic fiber paper. Fiberfrax Duraboard is manufactured by a wet forming process using primarily amorphous alumina-silica fibers and binders. Typical chemical properties of Duraboard products are provided in Table 1.

TABLE 1

Typical Chemical Properties of Duraboard Products

| Component | Weight Percentage |
|---|---|
| $SiO_2$ | 47.0–53.0 |
| $Al_2O_3$ | 44.0–52.0 |
| $Fe_2O_3$ | 0.3–0.8 |
| $TiO_2$ | 0.5–1.0 |
| $NaO_2$ | 0.1–1.0 |
| Trace Elements | <1.0 |

Fiberfrax ceramic fiber paper consists primarily of an alumino-silicate fiber in a non-woven matrix with a latex binder system. The ceramic fibers are randomly oriented in the paper making process, forming uniform, flexible, low weight sheets.

The fully suspended silica slurry used was MM-4, the trade designation for a mold stool coating available from Magneco/Metrel, Inc., Negley, Ohio. MM-4 includes 60–70% crystalline silica, 30–40% water, and 0.07% sodium arthophenyl phenate tetrahydrate, all percentages by weight. The silica suspensions were applied to the wooden riders by painting the wooden rider or by dip immersing the rider within the suspension. However, other methods will be readily apparent to those skilled in the art. The silicon steel was representative of conventional grain oriented electrical silicon steels typically having 2.5–3.5% silicon and the balance iron. Non-oriented silicon steels having a lower silicon content may also be useful. The actual compositions of such steels do not appear to be critical to the present invention, but such steels having a conventional refractory oxide coating, such as magnesium oxide, and any typical insulative forsterite coating may be useful. The edge conditions (judged by visual inspection) of coils hot rolled from the reheated slabs are provided in Table 2.

TABLE 2

Edge Quality of Coils Produced From AISI Type 419 Slabs Reheated on Experimental Riders

| Coil # | Edge | Coating In Contact With Edge | Hot Rolled Band Edge Condition |
|---|---|---|---|
| 1 | SR[a] | colloidal silica | 4 areas of light checks |
| | PH[b] | colloidal silica | 4 areas of light checks |
| 2 | SR | colloidal silica | 4 areas of light checks |
| | PH | ¼" Fiberfrax board | 4 areas of very light checks |
| 3 | SR | ¼" Fiberfrax board | 1 area of very light checks |
| | PH | ¼" Fiberfrax board | 2 areas of very light checks |
| 4 | SR | ¼" Fiberfrax board | 3 areas of very light checks |
| | PH | ⅛" Fiberfrax paper | 2 areas of light checks |
| 5 | SR | ⅛" Fiberfrax paper | 3 areas of light checks |
| | PH | ⅛" Fiberfrax paper | 4 areas of light checks |
| 6 | SR | ⅛" Fiberfrax paper | 3 areas of light checks |
| | PH | wood | 3 areas of moderate checks |
| 7 | SR | ¼" Fiberfrax board | 4 areas of light checks |
| | PH | ¼" Fiberfrax board | moderate checks through ½ of coil |
| 8 | SR | ¼" Fiberfrax board | 3 band of very light edge checks and bread dough |
| | PH | ¼" Fiberfrax board coated with colloidal silica | 1 band of light checks |
| 9 | SR | ¼" Fiberfrax board coated with colloidal silica | 1 band of bread dough |

TABLE 2-continued

Edge Quality of Coils Produced From AISI Type 419 Slabs Reheated on Experimental Riders

| Coil # | Edge | Coating In Contact With Edge | Hot Rolled Band Edge Condition |
|---|---|---|---|
| | PH | ¼" Fiberfrax board coated with colloidal silica | no checks |
| 10 | SR | ¼" Fiberfrax board coated with colloidal silica | 1 band of bread dough |
| | PH | MM-4 mold stool coating | no checks |
| 11 | SR | MM-4 mold stool coating | no checks |
| | PH | MM-4 mold stool coating | no checks |
| 12 | SR | MM-4 mold stool coating | no checks |
| | PH | ⅜" Fiberfrax paper | no checks |
| 13 | SR | ⅜" Fiberfrax paper | no checks |
| | PH | ⅜" Fiberfrax paper | no checks |
| 14 | SR | ⅜" Fiberfrax paper | no checks |
| | PH | 0.014" silicon steel with MgO coating | wrap with very light edge checks |
| 15 | SR | 0.014" silicon steel with MgO coating | no checks |
| | PH | 0.014" silicon steel with MgO coating | 2 wraps with very light edge checks |
| 16 | SR | 0.014" silicon steel with MgO coating | no checks |
| | PH | wood | 4 bands of light/moderate checks |

[a]SR indicates that the coil edge evaluated corresponded to the leading edge of the slab.
[b]PH indicates that the coil edge evaluated corresponded to the trailing edge of the slab.

All of the materials tested reduced carbon diffusion into the slab compared to uncoated wooden riders, and correspondingly reduced the frequency and severity of edge checking on the hot rolled coils. The MM-4 mold stool coating and ⅜ inch of Fiberfrax paper best reduced edge checking. Samples obtained from the coils reheated on wooden riders coated with either of the two preferred materials showed that no carbon pick-up occurred on the slab edges in contact with the riders.

From the above, the preferred rider is a wooden L-shaped rider having a first member which is substantially consumable at the operating temperature of the furnace and a second member treated with either MM-4 mold stool coating or Fiberfrax paper so as to be substantially non-consumable at the furnace's operating temperature. In using the preferred rider, when the slab exits from the furnace, the second member need only be knocked off of the slab edge. The heated slab may then be transported for further processing.

In an alternative embodiment of the present invention, the silica bearing coating may be applied by painting or the like to the edge of the slabs in the area where the slab contacts the second member of the rider. Mold stool coatings, such as those previously described here, could be useful for this purpose. In the case of wooden riders used to support such a coated slab, the uncoated first and second members of the rider would be substantially consumed during slab reheating; however, carbon migration to the slab should be eliminated. Although not yet tested, such an embodiment and other embodiments are within the scope of the present invention.

It will be understood that other possible materials useful for producing the riders of the present invention will be readily apparent to those of ordinary skill in the art after considering the foregoing disclosure. Further, it will be understood that other possible coating or liner materials capable of inhibiting carbon diffusion into a steel slab will be readily apparent to those of ordinary skill in the art. For example, a number of other materials capable of withstanding the high temperatures of slab heating furnaces may prove satisfactory. Such materials may include other materials having refractory properties, such as fireclay and dolomite. In addition, other mold stool coatings containing greater amounts of silica than MM-4 coating are commercially available, such as MM-10, available from Magneco/Metrel, and Q-Sil T coating, available from Quigley Company, Inc., of the Pfizer Specialty Minerals Group, New York, N.Y., MM-10 is the trade designation for a mold stool coating which differs from MM-4 in that MM-10 has 10% more colloidal silica binder system, this being equivalent to 2–3% more $SiO_2$ in the calcined state. Q-Sil T is the trade designation for a fully suspended refractory coating consisting of silica green with a colloidal silica binder. It is believed that these silica-rich materials would also provide suitable protection against decomposition of the second member and carbon pick-up. Although not specifically mentioned, such materials are intended to be incorporated into the present disclosure and are within the scope of the following claims.

What we claim is:

1. An apparatus for supporting a steel slab and for conveying the steel slab into and out of a furnace, the apparatus comprising:

a first portion configured to contact the bottom surface of the steel slab and support the weight of the steel slab, the first portion effective to prevent the marking of the bottom surface of the slab as it is advanced over a surface, the first portion is comprised of a material which is substantially consumed during slab heating in the furnace; and a second portion attached to the first portion and configured to contact a side surface of the steel slab and thereby prevent the slab from sliding off the first position, the second portion is comprised of a material which inhibits the movement of carbon from the second portion to the steel slab during slab heating in the furnace and which is rendered substantially nonconsumable by having a surface layer of different material thereon and wherein the surface layer is comprised of silicon steel having a refractory oxide surface coating.

2. An apparatus for supporting a steel slab and for conveying the steel slab into and out of a furnace, the apparatus comprising:

a first portion configured to contact the bottom surface of the steel slab and support the weight of the steel slab, the first portion effective to prevent the marking of the bottom surface of the slab as it is advanced over a surface, the first portion is comprised of a material which is substantially consume during slab heating in the furnace; and a second portion attached to the first portion and configured to contact a side surface of the steel slab and thereby prevent the slab from sliding off the first position, the second portion is comprised of a material which inhibits the movement of carbon from the second portion to the steel slab during slab heating in the furnace and which is rendered substantially nonconsumable by having a surface layer of different material thereon and wherein the surface layer is a refractory material of primarily silica.

3. The apparatus of claim 2 wherein the silica is colloidal silica, a silica slurry, or a colloidal silica-based mold stool coating including additional silica in suspension.

4. The apparatus of claim 3 wherein the silica suspension comprises at least about 60% silica by total weight of the suspension.

5. The apparatus of claim 2 wherein the surface layer is a refractory material of a ceramic fiber comprising alumina and silica.

6. The apparatus of claim 5 wherein the ceramic fiber is in board form having a total thickness of at least about ¼ inch.

7. The apparatus of claim 5 wherein the ceramic fiber is coated with a layer comprising silica.

8. An apparatus for supporting a steel slab for conveying the steel slab into and out of a slab heating furnace, the apparatus comprising:

a first member configured to contact the bottom surface of the steel slab for supporting the weight of the steel slab, the first member being made of a material which is both effective to protect the slab's bottom surface as it is advanced into the furnace and is substantially consumed during slab heating in the furnace; and a second member, attached to the first member, configured to contact a side surface of the steel slab, the second member comprised of a wood having a surface layer comprising a material with high temperature stability and low thermal conductivity at temperatures greater than about 2000° and which is substantially unaffected by the slab heating in the reheat furnace, the surface layer being effective to render the second member substantially non-consumable at the operating temperature of the reheat furnace.

9. The apparatus of claim 8 wherein the surface layer is a refractory material.

10. The apparatus of claim 9 wherein the refractory material is silica, magnesium oxide, or a ceramic fiber comprising alumina and silica.

11. A method for transporting and protecting a steel slab during its entry into and exit from a slab heating furnace, the method comprising:

disposing the slab on one or more riders before the slab enters the furnace, the riders comprising a first member contacting the slab's bottom surface, supporting the slab's weight, and protecting the slab's bottom surface as it advances over a surface, and a second member, attached to the first member, contacting the leading edge of the slab;

providing a surface layer between the leading edge of the slab and the second member, the surface layer having high temperature stability and low thermal conductivity;

transporting the slab into the furnace and heating the slab while disposed on the one or more riders;

exiting the slab from the furnace; and conveying the slab for further processing without the riders.

12. The method of claim 11 wherein the first member is substantially consumable during slab heating in the furnace and the second member is substantially non-consumable at the operating temperature of the furnace, the method further comprising allowing the first member to be substantially consumed in the furnace during the heating of the slab, the surface layer rendering the second member substantially non-consumable.

13. The method of claim 11 wherein both the first and second members are substantially consumable during slab heating in the furnace, and wherein the surface layer applied to the leading edge of the slab near the second member inhibits movement of carbon into the slab edge.

14. The method of claim 11 wherein the slab, on exiting from the furnace, has edge surfaces substantially free of contaminants from the decomposition of the second member.

15. The method of claim 11 wherein the steel slab, disposed on the one or more riders, is transported into and exited out of the furnace over a skid bar system.

* * * * *